US007614756B2

(12) United States Patent
Yue

(10) Patent No.: US 7,614,756 B2
(45) Date of Patent: Nov. 10, 2009

(54) ADJUSTABLE SLOT MIRROR

(76) Inventor: Chi Yau Yue, Block A, Unit 10, 51F Profit Industrial Building 1-15 Kwai Fung, N.T., Hong Kong (HK)

( * ) Notice: Subject to any disclaimer, the term of this patent is extended or adjusted under 35 U.S.C. 154(b) by 335 days.

(21) Appl. No.: 11/766,538

(22) Filed: Jun. 21, 2007

(65) Prior Publication Data

US 2008/0316626 A1 Dec. 25, 2008

(51) Int. Cl.
*G02B 7/182* (2006.01)
*A45D 42/02* (2006.01)

(52) U.S. Cl. ..... 359/872; 132/304

(58) Field of Classification Search ..... 359/871, 359/872, 875, 881; 248/448, 449, 477; 108/5, 108/10; 281/42, 49; 132/301, 304, 316
See application file for complete search history.

(56) References Cited

U.S. PATENT DOCUMENTS 4,500,169 A * 2/1985 Donnelly ..... 359/871
5,651,525 A * 7/1997 Yang ..... 248/456

* cited by examiner

*Primary Examiner*—Alessandro Amari
(74) *Attorney, Agent, or Firm*—Eric Hanscom; Todd Langford

(57) ABSTRACT

A mirror device includes a base portion having a top surface, a bottom surface, a first end, and a second end, the first end having a raised edge perpendicular to the top surface, the second end having a raised edge perpendicular to the top surface and having a curved portion extending therefrom, the base portion having a plurality of grooves parallel with the first and second ends, a connector portion coupled to the base portion, the first end of the connector portion coupled to the curved portion such that the connector portion may rotate about the base portion, and a mirror coupled to the second end of the connector portion, the mirror having a connection means horizontally disposed along the back portion thereof, the second end of the connector portion coupled to the connection means such that the mirror may rotate about the second end of the connector portion.

20 Claims, 3 Drawing Sheets

ADJUSTABLE SLOT MIRROR

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND

The embodiments of the invention generally relate to the field of cosmetic devices. More specifically, the embodiments of the invention relate to a mirror device that may be adjustably positioned.

Mirrors have been used for centuries. One type of mirror, a compact mirror, is often carried in small bags and purses for convenience. However, many mirrors are not adequately protected to prevent scratching and breakage during transport. Additionally, many compact mirrors require the user to hold the mirror in one hand during use of the mirror. Further, many compact mirrors that are "hands free" do not provide the user the ability to be adjusted so that the user can have multiple viewing angles.

Therefore, there is a current need for mirror device that may be adjustably positioned at various angles, that is compact, that does not require the use of one of the user's hands, and that may be protected from scratching and breakage during transport.

In this respect, before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

BRIEF SUMMARY OF SOME EMBODIMENTS

One embodiment of the adjustable slot mirror device includes a base portion, a connector portion, and a mirror. The base portion includes a top surface, a bottom surface, a first end, and a second end. The first end may have a raised edge perpendicular to the top surface. The second end may have a raised edge perpendicular to the top surface and may have a curved portion extending therefrom. The base portion may contain a plurality of grooves formed along at least a portion thereof. The plurality of grooves may be parallel with the first end and the second end. The connector portion is coupled to the base portion, with the first end of the connector portion coupled to the curved portion extending from the raised edge of the second end such that the connector portion may rotate with respect to the base portion. The mirror may be coupled to the second end of the connector portion. The mirror may have a reflective front surface and a connection means horizontally disposed along the back portion of the mirror. The second end of the connector portion may be coupled to the connection means such that the mirror may rotate about the second end of the connector portion.

Another embodiment of the adjustable slot mirror device includes a base portion, a connector portion, and a mirror. The base portion includes a top surface, a bottom surface, a first end, and a second end. The first end may have a raised edge perpendicular to the top surface. The second end may have a raised edge perpendicular to the top surface and may have a curved portion extending therefrom. The base portion may contain a plurality of grooves formed along at least a portion thereof. The plurality of grooves may be parallel with the first end and the second end. The connector portion is coupled to the base portion, with the first end of the connector portion coupled to the curved portion extending from the raised edge of the second end such that the connector portion may rotate with respect to the base portion. The mirror may be coupled to the second end of the connector portion. The mirror may have a reflective front surface and a connection means horizontally disposed along the back portion of the mirror along the central axis of the length of the mirror. The second end of the connector portion may be coupled to the connection means such that the mirror may rotate about the second end of the connector portion. The device may include means, such as a non-metallic strip of material, coupled to the base portion adjacent to the first end for preventing the mirror from contacting the base portion adjacent to the first end.

There has thus been outlined the features of some embodiments of the invention in order that the detailed description thereof may be better understood, and in order that the present contribution to the art may be better appreciated. There are additional features of the embodiments of the invention that will be described hereinafter and which will form the subject matter of the claims appended hereto.

BRIEF DESCRIPTION OF THE DRAWINGS

The accompanying drawings, which are incorporated in and form a part of this specification, illustrate embodiments of the invention and together with the description, serve to explain the principals of the embodiments of the invention.

DETAILED DESCRIPTION OF SOME EMBODIMENTS

Figure 1:
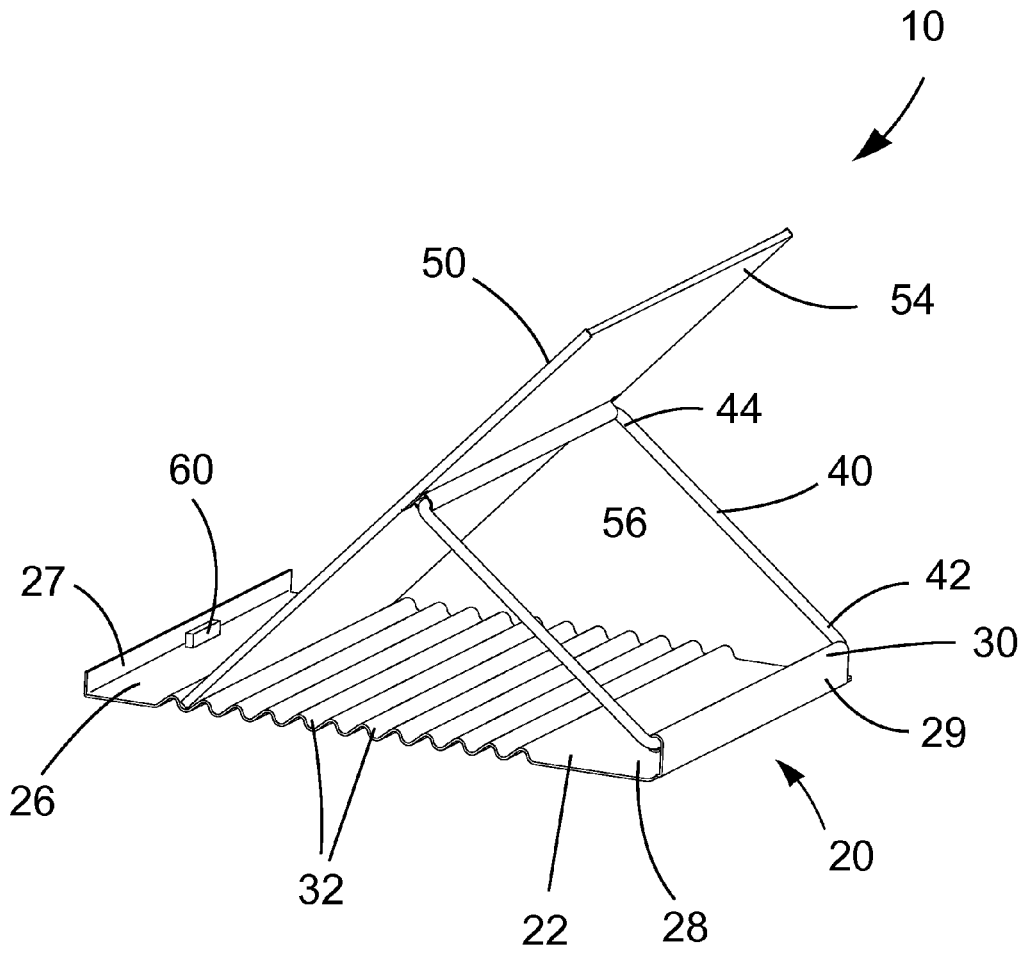
FIG. 1 shows a side perspective view of an embodiment of the adjustable slot mirror device in the viewing position.
Figure 2:
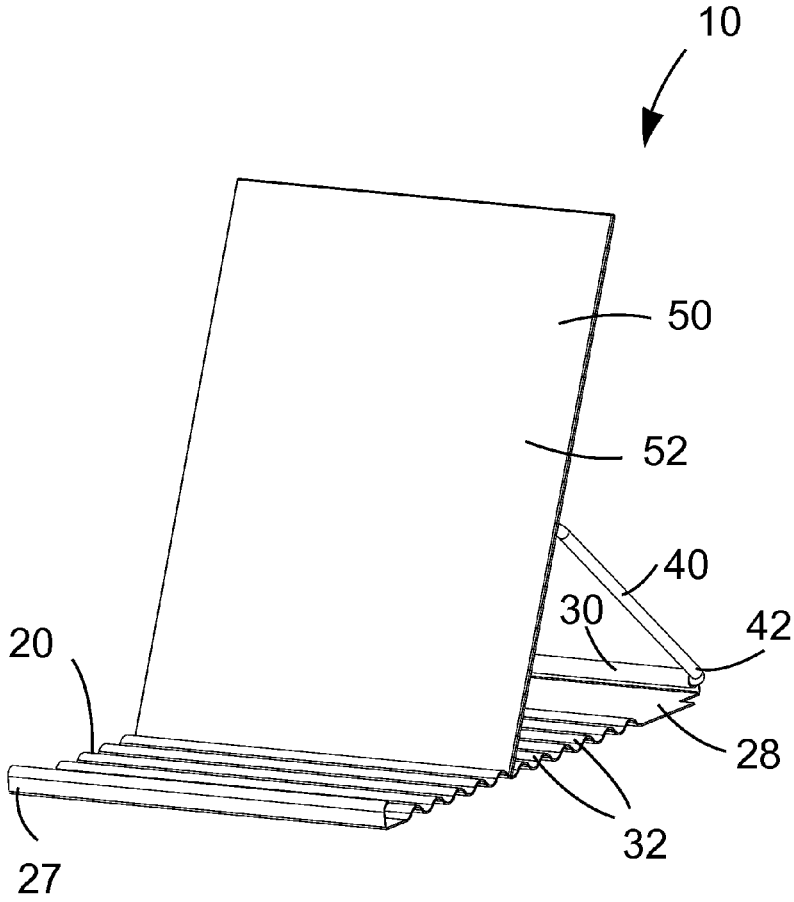
FIG. 2 shows a front perspective view of an embodiment of the adjustable slot mirror device in the viewing position.

Referring now to the drawings, wherein similar parts are identified by like reference numerals, FIGS. 1 and 2 show a side perspective view and a front perspective view, respectively, of an embodiment of the adjustable slot mirror device 10. Device 10 may include a base portion 20, a connector portion 40, and a mirror 50. Base portion 20 may include a top surface 22, a bottom surface 24, a first end 26, and a second end 28. First end 26 may have a raised edge 27 perpendicular to top surface 22. Second end 28 may have a raised edge 29 perpendicular to top surface 22 and may have a curved portion 30 extending therefrom. Base portion 20 may contain a plurality of grooves 32 formed along at least a portion thereof. Grooves 32 may be parallel with first end 26 and second end 28. Grooves 32 may extend the entire width of base portion 20, or only a portion of the width of base portion 20. Grooves 32 may be angled, semi-circular, square shaped, or other shapes as recognized by one having ordinary skill in the art. Base portion 20 may be comprised of a metallic material, such as copper, bronze, stainless steel, silver, platinum, and gold. However, in other embodiments, base portion 20 may be comprised of a polymer based material. Base portion 20 may comprise various shapes, including but not limited to rectangular, square, and circular.

Connector portion 40 is coupled to base portion 20, with the first end 42 of connector portion 40 coupled to curved portion 30 extending from the raised edge 29 of second end 28 such that connector portion 40 may rotate with respect to base portion 20. The ability for connector portion 40 to rotate with respect to base portion 20 helps a user transform device 10 from a viewing position, wherein a user may place device 10 on a surface and look into mirror 50 (as shown in FIGS. 1 and 2), to a collapsed position, wherein mirror 50 is not exposed and is disposed within base portion 20 such that device 10 is compact and capable of protected transport (see FIGS. 3, 4, and 6). In one embodiment, connector portion 40 may be shaped as a rod bent such that it contains at least three sides, wherein one side is coupled to curved portion 30 and the other two sides are used to support mirror 50.

Mirror 50 may be coupled to second end 44 of connector portion 40. Mirror 50 may have a reflective front surface 52 and a connection means 56 horizontally disposed along the back portion 54 of mirror 50. As shown in FIG. 1, connection means may be a tubular region disposed at least partially along back portion 54 of mirror 50. Second end 44 of connector portion 40 may be coupled to connection means 56 such that mirror 50 may rotate about second end 44 of connector portion 40. The ability for connector portion 40 to rotate with respect to second end 44 of connector portion helps a user transform device 10 from a viewing position, wherein a user may place device 10 on a surface and look into mirror 50 (as shown in FIGS. 1 and 2), to a collapsed position, wherein mirror 50 is not exposed and is disposed within base portion 20 such that device 10 is compact and capable of protected transport (see FIGS. 3, 4, and 6). Mirror 50 may comprise various shapes, including rectangular, square, and circular. Mirror 50 may be sized to fit between first end 26 and second end 28 of base portion 20, such that the back portion of mirror 50 may be flush with raised edge 27 and raised edge 29 when device 10 is in the collapsed position.

Device 10 may also include a strip of material 60, coupled to base portion 20 adjacent to first end 26, for preventing mirror 50 from contacting base portion 20 adjacent to first end 26. Strip of material 60 may be non-metallic, such as rubber or foam. Strip of material 60 may span the entire width of base portion 20, or may be any length shorter than the entire width of base portion 20. In other embodiments, strip of material 60 may be positioned anywhere along the length of base portion 20. The height of strip of material 60 may be any height less than or equal to the height of raised edge 27. Strip of material 60 may comprise various shapes, such as rectangular and square.

Figure 3:
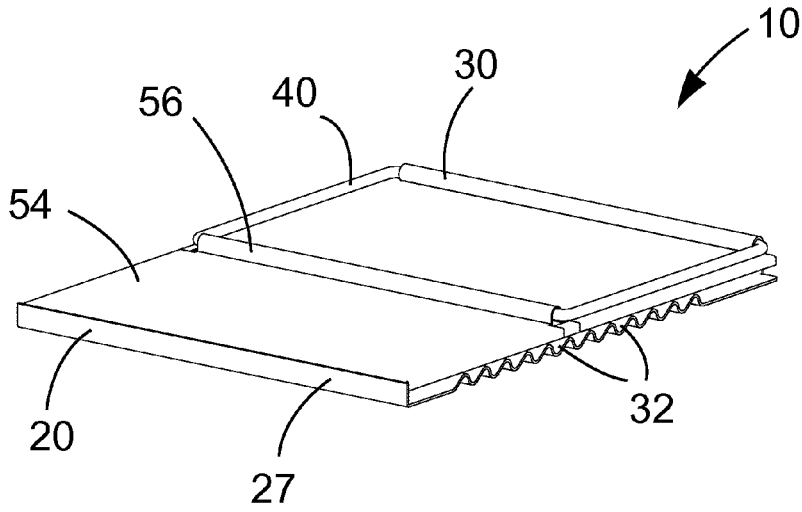
FIG. 3 shows a front perspective view of an embodiment of the adjustable slot mirror device in the collapsed position.
Figure 4:
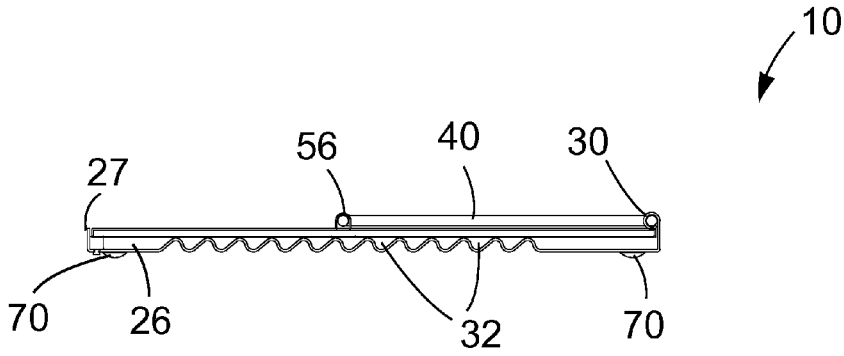
FIG. 4 shows a side view of an embodiment of the adjustable slot mirror device in the collapsed position.
Figure 5:
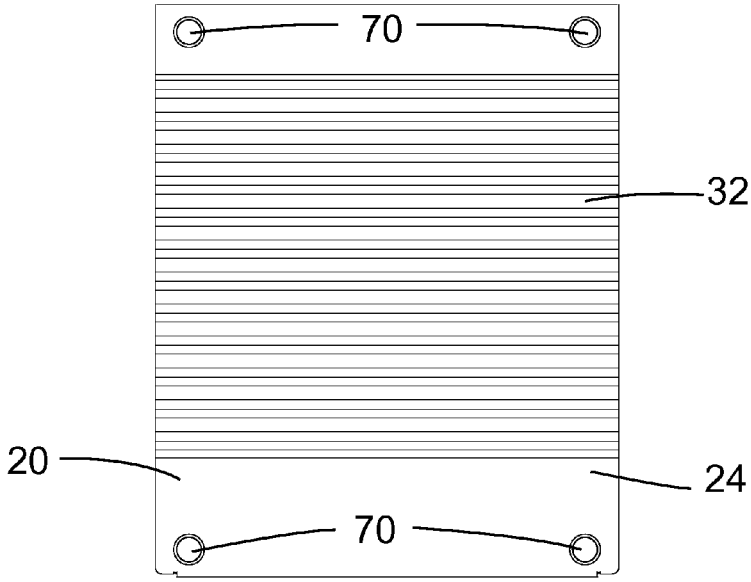
FIG. 5 shows a bottom view of an embodiment of the adjustable slot mirror device.
Figure 6:
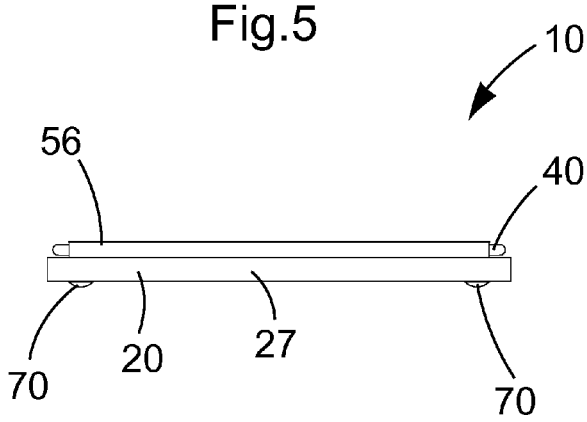
FIG. 6 shows an end view of an embodiment of the adjustable slot mirror device.

Referring to FIGS. 3 and 4, FIG. 3 shows a front perspective view of an embodiment of device 10 in the collapsed position, while FIG. 4 shows a side view of an embodiment of device 10 in the collapsed position. As shown in FIG. 4, device 10 may include at least two padding members 70 coupled to bottom surface 24 of base portion 20. Padding members 70 may be comprised of non-metallic materials, such as foam or rubber. In one embodiment, device 10 includes four padding members 70. However, in other embodiments, device 10 may include more or less padding members 70. Padding members 70 may comprise various shapes and sizes as recognized by those having ordinary skill in the art. Referring to FIGS. 5 and 6, FIG. 5 shows a bottom view of an embodiment of device, while FIG. 6 shows an end view of an embodiment of device 10 in the collapsed position.

With respect to the above description it is to be realized that the optimum dimensional relationships for the parts of the invention, including variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents fall within the scope of the present invention.

The above description, together with the advantages of the invention and the various features of novelty which characterize the invention, are pointed out with particularity in the claims annexed to and forming a part of this disclosure. For a better understanding of the invention, its operating advantages and the specific advantages attained by its uses, reference should be made to the accompanying drawings and descriptive matter in which there are illustrated preferred embodiments of the invention.

Further, the purpose of the foregoing abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting, as to the scope of the invention in any way.

What is claimed is:

1. A mirror device comprising:

a base portion, the base portion having a top surface, a bottom surface, a first end, and a second end, the first end having a raised edge perpendicular to the top surface, the second end having a raised edge perpendicular to the top surface and having a curved portion extending therefrom, the base portion having a plurality of grooves formed along at least a portion thereof, the plurality of grooves parallel with the first end and the second end;

a connector portion coupled to the base portion, the first end of the connector portion coupled to the curved portion extending from the raised edge of the second end such that the connector portion may rotate with respect to the base portion; and a mirror coupled to the second end of the connector portion, the mirror having a reflective front surface and a connection means horizontally disposed along the back portion thereof, the second end of the connector portion coupled to the connection means such that the mirror may rotate about the second end of the connector portion.

2. The mirror device of claim 1, wherein the connection means is a tubular region disposed at least partially along the back portion of the mirror.

3. The mirror device of claim 1, further comprising a means, coupled to the base portion adjacent to the first end, for preventing the mirror from contacting the base portion adjacent to the first end.

4. The mirror device of claim 3, wherein the means for preventing the mirror from contacting the base portion adjacent to the first end is a strip of non-metallic material.

5. The mirror device of claim 1, wherein the base portion is comprised of a metallic material.

6. The mirror device of claim 5, wherein the metallic material is selected from the group of metals consisting of copper, bronze, stainless steel, silver, platinum, and gold.

7. The mirror device of claim 1, wherein the base portion and the mirror are rectangular in shape, wherein the mirror is sized to fit between the first end and the second end of the base portion.

8. The mirror device of claim 1 further comprising at least two padding members coupled to the back side of the base portion.

9. The mirror device of claim 1, wherein the connection means is disposed along the back side of the mirror along the central axis of the length of the mirror.

10. The mirror device of claim 1, wherein the connector portion is shaped as a rod having at least three sides, wherein one side is coupled to the curved portion and the other two sides support the mirror.

11. A mirror device comprising:

a base portion, the base portion having a top surface, a bottom surface, a first end, and a second end, the first end having a raised edge perpendicular to the top surface, the second end having a raised edge perpendicular to the top surface and having a curved portion extending therefrom, the base portion having a plurality of grooves formed along at least a portion thereof, the plurality of grooves parallel with the first end and the second end;

a connector portion coupled to the base portion, the first end of the connector portion coupled to the curved portion extending from the raised edge of the second end such that the connector portion may rotate with respect to the base portion;

a mirror coupled to the second end of the connector portion, the mirror having a reflective front surface and a connection means horizontally disposed along the back portion thereof along the central axis of the length of the mirror, the second end of the connector portion coupled to the connection means such that the mirror may rotate about the second end of the connector portion; and means, coupled to the base portion adjacent to the first end, for preventing the mirror from contacting the base portion adjacent to the first end.

12. The mirror device of claim 11, wherein the means for preventing the mirror from contacting the base portion adjacent to the first end is a strip of non-metallic material.

13. The mirror device of claim 11, wherein the base portion is comprised of a metallic material.

14. The mirror device of claim 11, wherein the base portion and the mirror are rectangular in shape, wherein the mirror is sized to fit between the first end and the second end of the base portion.

15. The mirror device of claim 11 further comprising at least two padding members coupled to the back side of the base portion.

16. The mirror device of claim 11, wherein the connector portion is shaped as a rod having at least three sides.

17. A method of using a mirror device, comprising, first, obtaining a mirror device where the mirror device comprises:

a base portion, the base portion having a top surface, a bottom surface, a first end, and a second end, the first end having a raised edge perpendicular to the top surface, the second end having a raised edge perpendicular to the top surface and having a curved portion extending therefrom, the base portion having a plurality of grooves formed along at least a portion thereof, the plurality of grooves parallel with the first end and the second end;

a connector portion coupled to the base portion, the first end of the connector portion coupled to the curved portion extending from the raised edge of the second end such that the connector portion may rotate with respect to the base portion; and a mirror coupled to the second end of the connector portion, the mirror having a reflective front surface and a connection means horizontally disposed along the back portion thereof, the second end of the connector portion coupled to the connection means such that the mirror may rotate about the second end of the connector portion, second, placing the mirror device on a substantially flat surface, third, adjusting the angle of the mirror device to provide a desired angle of reflection, and fourth, viewing the reflection in the mirror device.

18. The method of using a mirror device of claim 17, where the connection means of the mirror device is a tubular region disposed at least partially along the back portion of the mirror.

19. The method of using a mirror device of claim 18, where the mirror device further comprises a means, coupled to the base portion adjacent to the first end, for preventing the mirror from contacting the base portion adjacent to the first end, and where the means for preventing the mirror from contacting the base portion adjacent to the first end is a strip of non-metallic material.

20. The method of using a mirror device of claim 18, where the base portion of the mirror device is comprised of a metallic material and where the base portion and the mirror are rectangular in shape, wherein the mirror is sized to fit between the first end and the second end of the base portion.

* * * * *